US009205318B2

(12) United States Patent
Chiono et al.

(10) Patent No.: US 9,205,318 B2
(45) Date of Patent: Dec. 8, 2015

(54) GOLF TRAINING EQUIPMENT

(76) Inventors: Roberto Chiono, Rivarolo Canavese (IT); Matteo Delpodio, Rivarolo Canavese (IT)

( * ) Notice: Subject to any disclaimer, the term of this patent is extended or adjusted under 35 U.S.C. 154(b) by 0 days.

(21) Appl. No.: 14/118,511

(22) PCT Filed: May 16, 2012

(86) PCT No.: PCT/IB2012/052472

§ 371 (c)(1),
(2), (4) Date: Feb. 18, 2014

(87) PCT Pub. No.: WO2012/156935

PCT Pub. Date: Nov. 22, 2012

(65) Prior Publication Data

US 2014/0179452 A1 Jun. 26, 2014

(30) Foreign Application Priority Data

May 16, 2011 (IT) ..... TO2011A0437

(51) Int. Cl.

| | |
|---|---|
| ***A63B 69/36*** | (2006.01) |
| *A63B 57/00* | (2015.01) |
| *A63B 71/06* | (2006.01) |

(52) U.S. Cl.

CPC ..... *A63B 69/3676* (2013.01); *A63B 57/0056* (2013.01); *A63B 2071/0694* (2013.01); *A63B 2209/08* (2013.01)

(58) Field of Classification Search

CPC ..... A63B 69/3676
USPC ..... 473/257, 278, 261–265, 157–158, 181; 73/1.75–1.76; 33/1 N

See application file for complete search history.

(56) References Cited

U.S. PATENT DOCUMENTS 3,313,544 A 4/1967 Davis
4,732,390 A * 3/1988 McCollum ..... 473/264

(Continued)

FOREIGN PATENT DOCUMENTS

DE 20 2009 005190 12/2009
GB 504628 4/1939

(Continued)

OTHER PUBLICATIONS

PCT/IB2012/052472, Oct. 11, 2012, International Search Report and Witten Opinion.

*Primary Examiner* — Melba Bumgarner
*Assistant Examiner* — Laura L Davison
(74) *Attorney, Agent, or Firm* — Workman Nydegger

(57) ABSTRACT

Training equipment to verify the quality of his/her putt comprising a base arrangeable on the ground and on which a player can place and hit a golf ball, means for receiving the ball in a first predetermined position, and at least one pair of obstacles arrangeable on the base in a plurality of second predetermined positions in which the obstacles define therebetween at least one gate adapted to be passed through by the ball when hit by the player; in which each obstacle is made by a plate adapted to interact with the ball and supported by the base by means of an elastically deformable stem including an upper end, which integrally supports the plate, and a lower end anchored to the base by means of a first and a second magnetic element adapted to be reciprocally attracted, the first carried integrally by the lower end of the elastically deformable stem and supported on a upper face of the base; and the second carried by the base, which is rotatably coupled with a support provided with a goniometric scale visible through a window of the base.

11 Claims, 2 Drawing Sheets

(56) References Cited

U.S. PATENT DOCUMENTS

| | | | | |
|---|---|---|---|---|
| 4,953,865 | A * | 9/1990 | Coombs et al. | 473/158 |
| 5,910,053 | A * | 6/1999 | Scalise | 473/257 |
| 6,155,931 | A * | 12/2000 | Perrine | 473/278 |
| 6,769,995 | B1 * | 8/2004 | Rhodes et al. | 473/265 |
| 7,566,277 | B2 * | 7/2009 | Dahl | 473/265 |
| 2006/0063604 | A1 * | 3/2006 | Amerson | 473/278 |
| 2011/0071437 | A1 * | 3/2011 | Merchant | 600/587 |

FOREIGN PATENT DOCUMENTS

| | | |
|---|---|---|
| JP | 48029535 | 4/1973 |
| JP | 48038966 | 5/1973 |
| JP | 52127572 | 9/1977 |
| JP | 53029463 | 3/1978 |
| WO | JP 59 033466 | 3/1984 |
| WO | WO 02/089928 | 11/2002 |
| WO | WO 2007/035142 | 3/2007 |

* cited by examiner

GOLF TRAINING EQUIPMENT

TECHNICAL FIELD

The present invention relates to training equipment usable by an amateur or professional golf player to check and, possibly, improve the quality of his/her "putt", i.e. of the (usually) last stroke with which one attempts to strike the ball into the hole, or in the technical jargon of the field, "sink the putt".

BACKGROUND ART

As being part of the game of golf, control and quality of the putt are of the utmost importance. The statistics in fact confirm that the quality of the game and its outcome depends more than 70% on this last stroke, which although the shortest in terms of distance to travel, is the most difficult and requires great precision and accurate movement (called "swing"), smoothly and regularly in line with the target (the hole).

From the document U.S. Pat. No. 6,503,152 is known an equipment which allows to be aware of certain characteristics of one's own putt, consisting of a flat plate, for example rectangular, being laid on the ground, oriented with the long sides in the direction of the hole; at a first end of said plane a recess is formed in order to receive in support the golf ball; one or more longitudinal tracks or grooves run parallel to the longer sides of the rectangular plane up at its opposite end, where, on both sides of the track or groove, between this latter and the major sides of the flat plate, are arranged a number of obstacles, consisting of balls or, better, of steel balls arranged on a series of transverse grooves or notches. In the case of a non perfect stroke, the golf ball which has been enacted by the specific putter will collide with one or more obstacles, moving them; the player should therefore realize where and in what direction the ball was deflected.

This solution, although simple and relatively inexpensive, has a number of drawbacks:

1. every time the golf ball touches a steel ball, this latter is moved, even out of the plate: it is therefore necessary to retrieve and reset it into its seat;

2. keeping the head and the eyes fixed, as is normal when performing a stroke, it is difficult if not impossible, to understand to what degree the steel ball has been bumped, touched or hit;

3. the golf ball hitting the obstacle consisting of a steel ball is slowed and/or deviated from the original direction; in fact, having the steel ball forming the obstacle a mass equal to about one-sixth of that of the golf ball, the momentum that is transferred during the impact is not negligible; this actually alters the direction and quality of the stroke by introducing an additional and unpredictable variable, which greatly limits, in fact, the usefulness of the equipment.

U.S. Pat. No. 4,732,390 describes an equipment for training the swing consisting of a sort of concave tray having in the center a strip of artificial grass for supporting the ball and on the sides two rigid metal plates which support a series of elastically deformable obstacles that are retained in position in a removable way on the plates by magnets and which are arranged on the sides with respect to the correct trajectory that should be followed by the head of the putter during the swing. Thus, if the swing is not correctly performed, the head of the putter hits one or more obstacles moving and putting them into vibration, so that the user player is aware of the error/mistake committed.

In addition to being bulky, said equipment does not overcome all the disadvantages highlighted earlier of the equipment according to U.S. Pat. No. 6,503,152.

A training equipment conceptually very similar to that of U.S. Pat. No. 4,732,390, even if more simple and efficient, is known from WO2007/035142; in this case, the obstacles placed laterally to the trajectory of the head of the putter during the swing are located in an oblique way if hit by the head of the putter, thanks to having their respective bases magnetically retained within recesses formed in the plate.

From DE202009005190 is finally known a training equipment consisting of a mat provided with a circular recess that forms an artificial hole within which the user player can sink a ball; in order to extract the ball from the artificial hole conveniently and without forcing the user player to bend over, the equipment is also provided with a rod equipped with two plates at the lower end; a first plate acts to be the support base for the rod and is in use inserted on the bottom of the artificial hole; a second plate, made of plexiglass, is supported spaced from the first plate of a quantity slightly greater than the diameter of a golf ball. When the ball is put into the hole, it stays "stuck" between the two plates and can be easily extracted from the hole by manipulating the rod. DE202009005190 is therefore related to a technical problem entirely different from that addressed by U.S. Pat. No. 6,503,152 and does not solve any of the related drawbacks.

DISCLOSURE OF INVENTION

The purpose of the present invention is to obviate the drawbacks described, by providing an equipment simple and easy to make and of relatively low cost, as the one according to U.S. Pat. No. 6,503,152, but even easier to use and which clearly allows to highlight, even after performing the stroke, to what degree the obstacle has been bumped, touched or hit, so as to make a visual account, even in retrospect, of the path followed by the ball, thus satisfying the features required by professionals, allowing to view the result of the putt stroke, both if it runs square and if it is pushed to the right or left.

Another problem that often occurs to the golf player is to evaluate the correct angle with respect to the hole of the direction to be used to strike the ball, which depends on numerous factors, including the irregularities of the playing field. In the event that an incorrect placement chosen by the player occurs, by excess or faulty evaluation of the slopes, the same player does not currently have any objective evidence to estimate the "degree" of the evaluation error. And this problem can not be solved in any way from the equipment of the state of the art described above.

It is therefore also an object of the invention to provide a training equipment which in addition to overcome the drawbacks previously highlighted allows the user player also to carry out this latter type of evaluation.

According to the invention a training equipment is therefore provided to be used in the game of golf as described in claims 1 through 11.

In particular, the equipment according to the invention comprises a base arrangeable on the ground and on which a player may place and hit a golf ball, means for receiving the ball on the base in a first predetermined position, and at least one pair of obstacles available on the base, preferably opposite to the means for receiving the ball, in a plurality of second predetermined positions in which the obstacles define therebetween at least a gate adapted to be passed through by the ball when it is struck by the player.

According to the main characteristic of the invention, each obstacle is formed by a plate adapted to interact with the ball when it crosses the gate in a non-aligned way with the same and colliding with the obstacle itself, which plate is supported by the base through an elastically deformable stem delimited by an upper end, which supports integral the plate, and a lower end, which is anchored to the base so as not to be moved as a result of an impact between ball and obstacle.

In particular, the lower end of the elastically deformable stem is anchored to the base by means of a first and a second magnetic element adapted to be reciprocally attracted; the first magnetic element is carried integrally by the lower end of the elastically deformable stem and is arranged supported on an upper face of the base; and the second magnetic element is supported on a lower face of the base so that the base remains clamped between the first and the second magnetic element with a preset force, or is incorporated co-molded in the thickness of the base.

Here and hereinafter, the term "magnetic element" is meant, indifferently, an element consists of a magnet, preferably a permanent magnet, or an element that can interact with the flux lines of a magnetic field, for example, concentrating them, as an element made of ferromagnetic material, such as iron or nickel.

The magnetic elements can be formed by means of a first and a second permanent magnet arranged with opposite poles facing the base.

According to a further aspect of the invention, the base can be formed by a polymeric sheet, preferably of rectangular profile, flat and smooth, rigid or flexible, in the second case may also be rolled up, so that it can be easily transported, placed and removed from the playing field.

In any case, the base is preferably provided, near the means for receiving the ball on the base, with a transparent window and, on the side of its lower face and in correspondence of the means for receiving the ball on the base, is coupled with a support for the base, adapted to rest directly on the ground in a stable manner and equipped with a a goniometric graduated scale, which receives in rotary manner the base to allow the base to be rotated on the support; the graduated scale (51), with the base coupled to the support, being visible through the transparent window.

BRIEF DESCRIPTION OF THE DRAWINGS

Further characteristics and advantages of the invention will become clear from the description that follows of a non-limiting embodiment thereof, made with reference to the figures of the accompanying drawings, wherein.

BEST MODE FOR CARRYING OUT THE INVENTION

With reference to FIGS. 1 to 5, is indicated as a whole with 1 a training equipment usable by a golf player user to verify the quality of the putt stroke.

Figure 1:
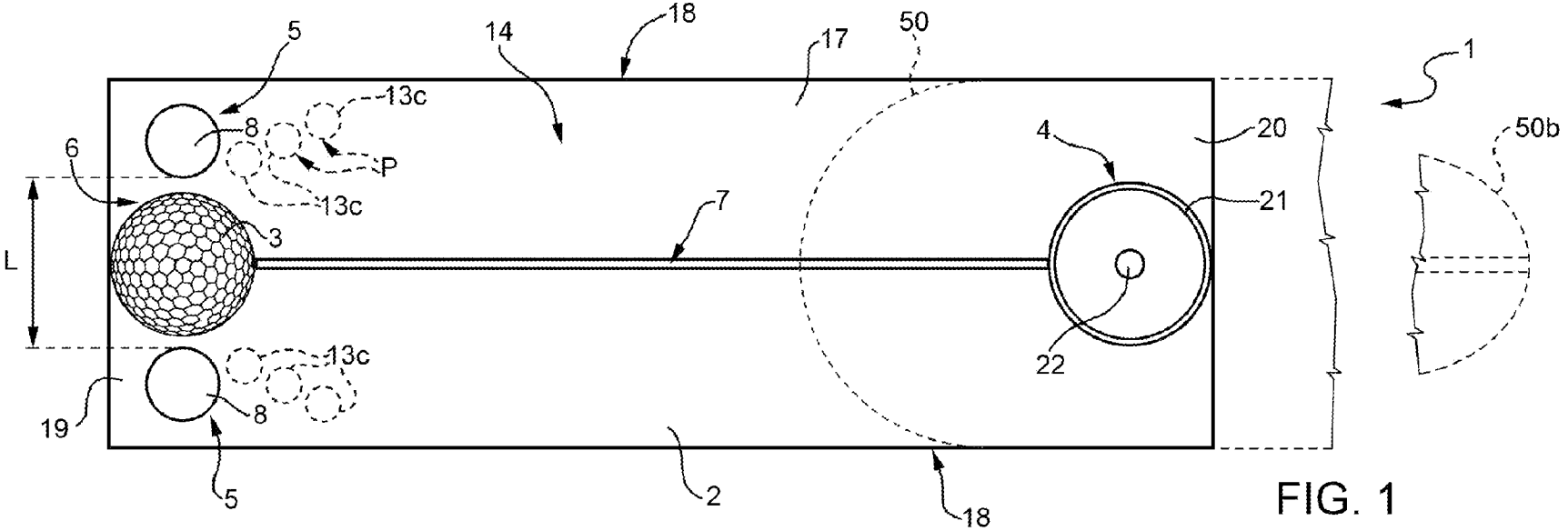
FIG. 1 illustrates a top plan view of the training equipment according to the invention, with details shown in broken lines for a better understanding.
Figure 3:
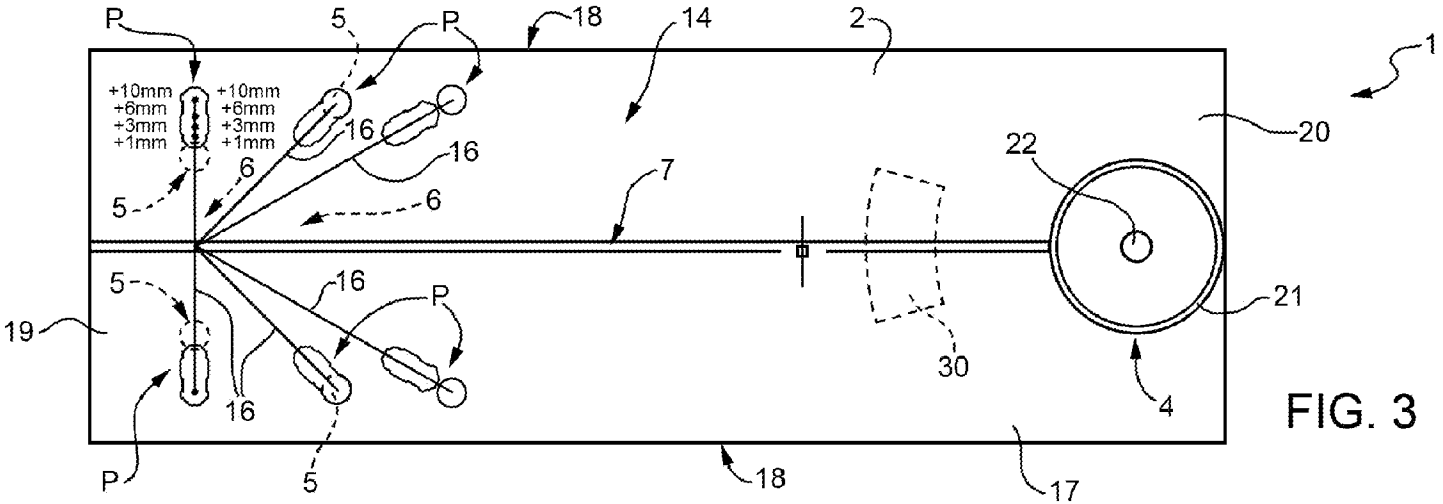
FIG. 3 illustrates a top plan view of a variant of the training equipment according to the invention.
Figure 4:
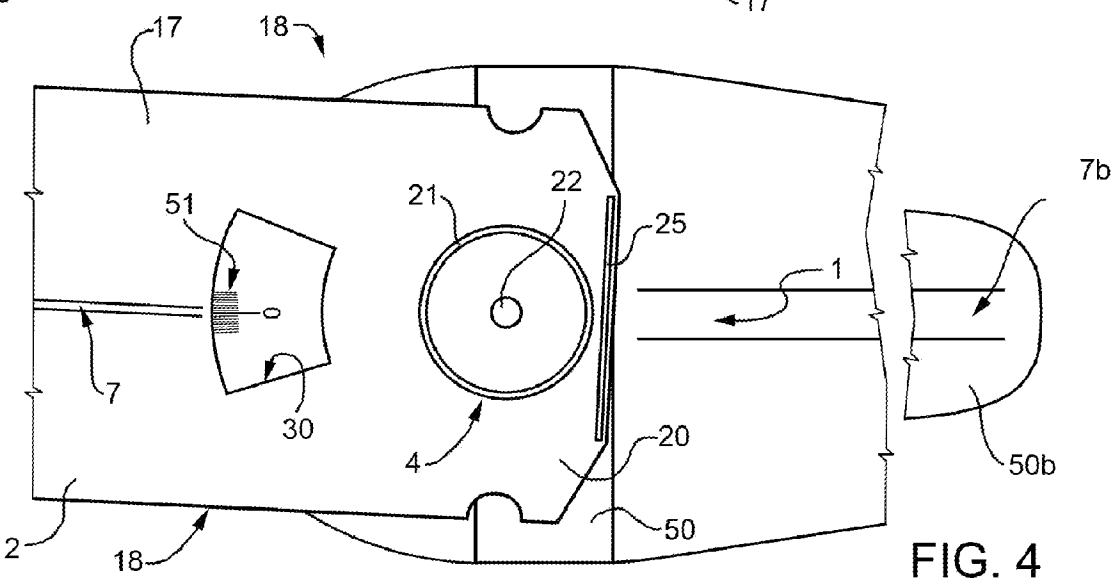
FIG. 4 shows a plan view from above of a detail of the training equipment according to the invention.

The equipment 1 comprises a base 2 arrangeable on the ground and on which a player (not shown for simplicity) can place and hit a golf ball 3, means 4 for receiving the ball on the base 2 in a first predetermined position marked by the means 4 for receiving, and at least one pair of obstacles 5 arrangeable on the base 2, preferably opposite to the means 4 for receiving the ball 3, in a plurality of second predetermined positions P (FIGS. 1 and 3), in which the obstacles 5 define therebetween at least one finishing gate 6 (FIG. 1) of width or amplitude L adapted to be passed through by the ball 3 when it is hit by the player. The amplitude L is measured transversely to a direction along which the player hits the ball 3 and that in the equipment of FIGS. 1 and 3 is defined by a rectilinear marking 7 made in the way that will be seen directly on the base 2.

According to the main characteristic of the invention, the obstacles 5, instead of being made as simple metal balls intended to be coupled with grooves of the base to be displaced in the case of an incorrect stroke, as in U.S. Pat. No. 6,503,152, are made, each, as a plate 8, preferably round and made of a plastic material, adapted to interact with the ball 3 when this passes through the gate 6 in a way not aligned with the same and consequently collides with an obstacle 5; each plate is supported by the base 2 by means of an elastically deformable stem 9 (FIG. 2) delimited by an upper end 10, which integrally supports the plate 8, and a lower end 11 anchored to the base 2 so as not to be moved as a result of an impact between ball 3 and obstacle 5.

Figure 2:
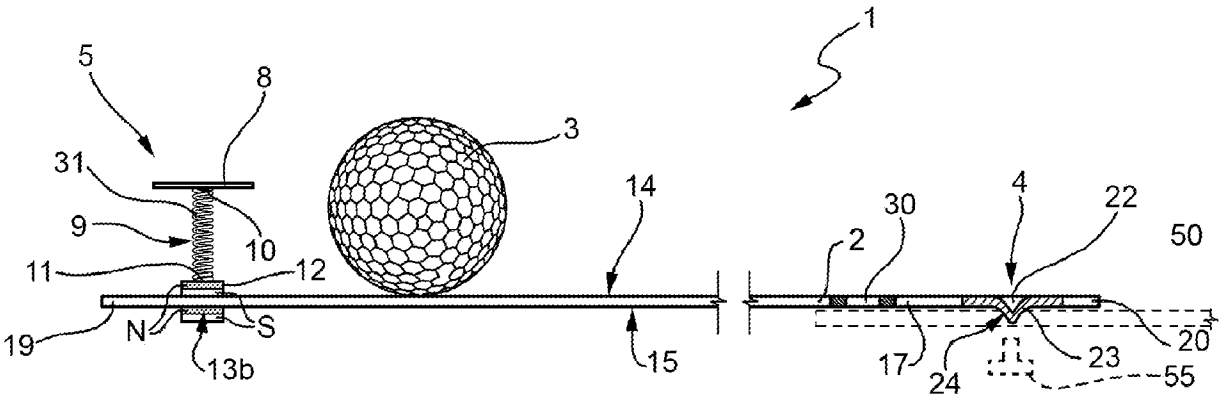
FIG. 2 shows in a slightly enlarged scale a longitudinal view in elevation and partly in section of details of the equipment of FIG. 1, some of which are illustrated in broken lines for a better understanding.

According to another and important aspect of the invention, the lower end 11 of the elastically deformable stem 9 is anchored to the base 2 by means of a first magnetic element 12 and a second magnetic element 13 adapted to attract each other; the first magnetic element 12 is carried integrally by the lower end 11 of the elastically deformable stem 9 and is arranged resting on an upper face 14 of the base 2; in the not limiting example of embodiment illustrated in FIG. 2, the second magnetic element 13 is a block 13*b* resting on a lower face 15 of the base 2, then in use facing the ground, in a position corresponding to that occupied by the first magnetic element 12 on the upper face 14 of the base 2, so that the base 2 (FIG. 2) remains clamped between the magnetic elements 12 and 13*b* with a preset force dependent on the magnetic force of attraction that is exerted in use between them.

According to a further aspect of the invention, in addition, the top 14 and bottom 15 faces of the base 2 are smooth and flat, so that the player, if necessary, can manually slide the first and second magnetic element 12 and 13*b* on them maintaining the first and second magnetic element 12 and 13*b* magnetically coupled to each other and mechanically coupled to each other and with the base 2, by magnetic force, so as to maintain the obstacles 5 coupled in a stable manner with the base 2.

The force with which the described obstacles 5 are stably coupled with the base 2 obviously depends on the magnetic force of attraction between the same, which, given their positioning integral with the base 2, allows the elements 12 and 13*b* to exert on the faces 14 and 15 a pressure that provides a coupling friction between each element 12 and 13*b* and the base 2. The user player can then move the obstacles 5 along the base 2 in any position, without failing the coupling with the same, simply overcoming the first detach friction exerting a lateral thrust on the same, parallel to the faces 14 and 15, or it can remove the obstacles 5 from the base 2 against the force of magnetic attraction between the elements 12 and 13*b*, thus allowing to separate from the base 2, individually, the element 13*b* on the one hand, and the element 12 with attached to it the stem 9 and the plate 8, on the other hand.

Figure 5:
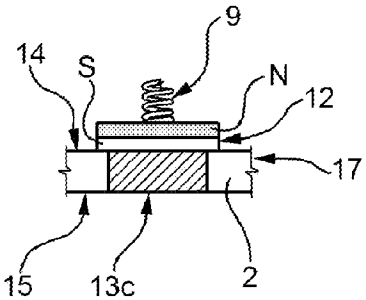
FIG. 5 shows in enlarged scale a view in elevation and in section of a detail of the equipment of FIG. 1.

According to the non-limiting example of embodiment shown in FIG. 5 and also in FIG. 1, but in broken lines, the second magnetic element 13 is a block 13*c*, which is integrally carried in one piece by the base 2, embedded (e.g.

co-molded) within the thickness of the same, measured perpendicular to the faces 14 and 15. In this case, the base 2 (FIG. 1) carries a plurality of blocks or magnetic elements 13*c* for each obstacle 5, positioned in predetermined points and the obstacles 5 may be selectively positioned only in a plurality of discrete positions, chosen beforehand, and not continuously in an infinite number of positions, as in the case of the elements 13*b*, manually removing and repositioning the elements 12 from/on the chosen elements 13*c*, with the plates 8 and with the stems 9 attached integral to the elements 12.

In any case, the force of attraction between elements 12 and 13 (13*b* and 13*c*), and the resulting force that keeps stably coupled with the base 2 the obstacles 5, is chosen according to the invention so that in case of impact between ball 3 and the plates 8, the pulse due to the transfer of momentum is not sufficient to overcome the force of attraction between elements 12 and 13*b, c*, for which the obstacles 5 are never displaced from the position that the player has chosen for them. Consequently, during the use of the equipment 1, the position and amplitude L of the target 6 defined between a pair of obstacles 5 arranged side by side, in this case between the peripheral edges of the plates 8, remains stable.

Therefore, by way of the first and second magnetic element 12 and 13*b, c*, obstacles 5 can be stably coupled to the base 2 so as to define between them, selectively, a plurality of gates 6 having an amplitude L, measured transversely to the direction along which the player hits the ball 3, progressively increasing or decreasing.

Preferably, the first and second magnetic element 12 and 13*b* are formed by means of a first and a second permanent magnet arranged with their opposite poles N, S facing the base 2 (FIG. 2).

Moreover, to facilitate the use of the equipment 1, the base 2 comprises means for performing predetermined orientation of the base towards a target, for example a hole of a golf course, consisting in the example shown, in the linear marking 7 formed starting from the means 4 for receiving the ball 3 on the base 2 and directed towards the obstacles 5.

The base 2 may further be provided with second markings 16 (according to the variant of FIG. 3) to tag on the base 2 the plurality of predetermined positions P in which must be placed in use the obstacles 5 to define the gates 6 of dimensions suitable to the type of game and player. The obstacles 5 will therefore be arranged, the better the player is, the closer they are to each other (so as to define a gate 6 of amplitude L little larger than the diameter of the ball 3) and greater the distance is from the receiving means 4. The player can also use the marking 7 to better direct the stroke.

For this purpose, the positions P defined by the markings 16 are chosen so that once one or more pairs of obstacles 5 are placed in correspondence to them, the gates 6 thus defined have their amplitude L arranged perpendicular to the straight linear marking 7.

The same effect is obtained by providing a plurality of magnetic elements 13*c* in the positions P selected, stably coupled in an integral manner with the base 2 (FIG. 1).

The markings 7 and 16 are carried by one of the opposite top and lower faces 14, 15 of the base 2 so as to result visible from the upper face 14; for this purpose, the base 2 is formed from a sheet 17, preferably but not necessarily of rectangular perimeter profile in plan view, flat, rigid or flexible, made of a polymeric material of predetermined thickness, preferably but not exclusively transparent. The material is preferably selected from the group consisting of PLEXIGLAS® and LEXAN®; is clear that even acetal resins or silicone or other suitable polymers for the purpose are also usable. The markings 7, 16, are formed on a face 14 or 15 of the sheet 17; if the latter is transparent, the markings 7, 16 will be in fact visible even if they are formed on the lower face 15. The material and thickness of the sheet 17 are chosen so that the sheet 17 is flexible only to an extent that it can adapt to the irregularities/slope of the terrain on which it lies, or, preferably, to such an extent that it can be rolled and unrolled in the direction of its predetermined orientation, i.e. parallel to the marking 7.

The markings 7, 16 can be silk-screened on the surface 14 (or 15) of the sheet 17, but it is clear that any other system of impression, such as pad printing, is equally suitable, in particular, the marking 7 will be formed at the centerline and for the entire length of the respective, opposing longitudinal sides 18, of greater length, of the rectangular sheet 17; the markings 16 will be obtained concentrated on one end 19 of sheet 17, opposite to one end 20 of the same at which are formed the receiving means 4. In all cases the elements 13*c* can easily be incorporated integral in one piece in the sheet 17.

The means 4 for receiving the ball 3 on the base 2 may only consist in a further circular marking 21 and/or, preferably, in a concave seat 22 obtained on the base 2 and adapted not only to mark the predetermined position for the ball 3 in which this must be hit in use, but also for receiving the ball 3 in a stable manner until this is not hit by the player. The seat 22 can be defined by a simple blind or passing circular hole made in the sheet 17, or, according to the non-limiting example of embodiment shown in solid line in FIG. 2, by an embossment 23 formed integrally with the sheet 17 and that defines with its concave part, facing upwards, the seat 22 and with its convex side, facing downwards, a tip 24, for example conical, which is projected perpendicularly cantilever from the lower face 15, near the end 20.

The tip 24, which is made by means of it the embossment 23 or in another way, it is always obtained from the part of the lower face 15 exactly in correspondence of the means 4 for receiving the ball 3, therefore, concentrically and coaxially with the seat 22 and, when present, the marking 21. The tip 24 has not only the purpose of anchoring the base 2 to the ground, in case of soft ground such as a lawn, but also and above all to enable easy and rapid orientation of precision towards a hole or other objective of the base 2.

Preferably (FIG. 4), the base 2 is also provided, near the means 4 for receiving the ball 3 on the base 2, with a line or a projection 25 arranged transversely to the direction along which the player hits the ball 3, and adapted to serve as a reference to the player to properly orient a putter to hit the ball 3 with respect to the ball 3 itself. Furthermore, according to the illustrated embodiments, the base 2 can be provided, always in proximity of the means 4 for receiving the ball 3 on the base 2, with a transparent window 30; this, if the sheet 17 is made of a transparent material, may be defined by a simple perimeter marking, or by a portion of sheet 17 left without a possible varnish adapted to cover part of one or both faces 14,15. Or be defined by a through perforation practiced through the sheet 17 made of opaque material and possibly closed by a transparent cap.

In any case, when there is the window 30 is also always present a support 50 for the base 2, adapted to rest directly on the ground in a stable manner and equipped with a goniometric graduated scale 51, the support being adapted for receiving in rotary manner the base 2 on the side of the end 20 thereof; in this case, the base 2 is necessarily provided with the window 30 and with the tip 24 (or of another support or link element having similar functionality), and has said tip 24 or equivalent element supported/connected rotatably on the support 50, possibly equipped with a suitable low friction seat, to enable the base 2 to be rotated on the support 50; the graduated scale 51 is formed in such a way that, when the base 2 is mounted on the support 50, it is visible through the transparent window 30.

According to that non-limitingly shown in broken lines in FIG. 2, the base 2 is permanently hinged connected, in rotary manner and in correspondence of the seat 22, e.g. coaxially to the receiving means 4, with the support 50 by way of an idle pin 55 or other element equivalent; of course, in this case, the tip 24 is absent.

The support 50 is preferably formed as an elongate element, which can be rotated, when the equipment 1 is not in use, under the base 2, while when the equipment is in use, is rotated so as to create a sort of extension of the base 2, on the opposite side to obstacles 5. The support 50 is therefore formed by a rectilinear and flat plate (possibly also rollable as well), terminating in a rounded end 50*b* and provided in a visible way on the side of face 14 with a marking 7*b* that when the goniometric scale 51 is set to zero (FIG. 4) results aligned with the marking 7.

The player who uses the equipment 1, then, evaluates the direction along which one would intuitively address the stroke and positions the base 2 with the marking 7 oriented at zero degrees with respect to the goniometric scale 51 (FIG. 4) and directed along said direction. Once the ball is putted at 0° without success, the player rotates the base 2 leaving fixed the support 50 which carries the goniometric scale 51 and reads on the latter the degree of rotation (clockwise or anticlockwise) of the base 2, once aligned the marking 7 of this latter along the new shot direction that he/she has chosen. At this point, repeats the stroke, if this goes wrong, one repeats the operation described, and so on, until obtaining a satisfactory stroke. The player, in this way, by reading the degree of rotation reached from time to time on the goniometer 51, precisely evidences to what degree may underestimate or overestimate the addressing assessed by eye.

Obviously, to perform this assessment, correctly, it will also require that during the stroke obstacles 5 are not touched by the ball. The player then can adjust his/her estimate and may determine whether said error is systematic or occasional and take note to automatically correct systematic errors.

The elastically deformable stems 9 of the obstacles 5 made according to the invention are preferably formed by helicoidal springs 31 with a low rigidity, presenting winding diameter significantly less than their length (i.e. with a diameter/length ratio between ⅕ and 1/10), of the type of those used in snap ball point pens to operate the push-push mechanism of the same.

In any case, the plates 8 have plan dimensions fairly greater than those of the stems 9 (i.e. the ratio between the diameter of the plates 8 and that of the stems 9 is of 5:1), e.g. of the winding diameter of the helicoidal springs 31, and are in turn made of a plastic material and so as to have a mass equal to approximately one fortieth of that of the golf ball 3.

In use, the user player places a ball 3 in the seat 22 and places the obstacles 5 on the side of the end 10 so as to achieve a gate 6 of amplitude L suited to his/her capacity. In this is helped by the presence of the markings 16. It is clear that the system: magnet 13*b* (or metallic element 13*c*)—magnet 12—spring 31—plate 8 allows the positioning of the obstacles both in positions already determined, for example by the markings 16 or by the elements 13*c*, or where the player prefers (in the case of elements 13*b*).

Once the stroke is performed, if it was correct, the ball 3 passes through the gate 6 defined by obstacles 5 without touching the plates 8. But when the stroke was not correct the ball 3 hits the plastic plate 8 of one of the obstacles 5 and the relative spring 31 begins to vibrate, keeping the oscillatory motion for several seconds, abundantly sufficient because, at completed stroke, the remaining oscillating movement of the plate 8 will be noticed by the player.

In addition, the mass of the plastic plate 8, plus the resistance of the spring is selected so as to be very small, about 1/40 the mass of the golf ball 3, so that both the change in direction and the exchange of energy (more precisely the momentum) resulting from the impact with the obstacle 5 are negligible; therefore the player receives the correct information from the analysis of the stroke. Moreover, the two magnetic elements 12 and 13*b*/13*c* guarantee, if not fully hit and with force, most unlikely event, the system stability. For each wrong stroke it is therefore unnecessary to reposition the obstacles 5.

According to a further possible variant of the invention not shown for ease as immediately intuitive on the basis of what has already been described, the assembly system of the parts 2, 50 can be improved.

In the lower face of the base 2 in correspondence of the housing 22 of the ball 3, which in this case will be a blind or through hole, as well as on the upper face of the support 50, a magnet is glued, not shown, of the type of the magnets 12, 13*b*, making sure that the magnets are glued on said faces so as to have in use facing opposite poles. The tip 24, instead of being obtained as an integral embossment with the base 2, is obtained as an independent element, such as a full cone and on its flat upper face, which defines the base, is glued a further magnet, having the same orientation of that glued on the support 50.

In the case in which the player wants to use only the base 2 he will apply to it the tip 24, which is retained by magnetic force in correspondence with the seat or housing 22. In the event that one wants to apply the goniometer 51 with the support 50, the player will instead apply the latter below the base 2, by means of the relative magnet, and can then still apply the tip 24 against the lower face of the support 50.

The invention claimed is:

1. A training equipment usable by a golf player user to verify the quality of his/her putt shot and comprising:

a base arrangeable on the ground, shaped so that, in use, a golf ball can be placed and hit on the base by a golf player, a receiving element for receiving in use a ball on the base in a first predetermined position, and at least one pair of obstacles arrangeable on the base, opposed to the receiving element for receiving the ball, in a plurality of second predetermined positions in which the obstacles define therebetween at least one gate of such dimensions as to be adapted to be passed through, in use, by the ball when it is hit by the player;

wherein each obstacle is formed by a plate adapted to interact in use with a golf ball when the golf ball passes through the at least one gate in a non-aligned way with the at least one gate to be hit by the golf ball; the plate being supported by the base by way of an elastically deformable stem including an upper end, which integrally supports the plate, and a lower end anchored to the base so as not to be moved as a result of an impact between the ball and the obstacle, wherein the base is provided, near said receiving element for receiving the ball on the base, with a transparent window and, on a side of its lower face and exactly in correspondence of said receiving element for receiving the ball on the base, with a pivotal connection support supporting the base, adapted to rest directly on the ground in a stable manner, provided with a goniometric graduated scale and, adapted to rotatably receive the base to allow the base to be rotated on the support; and, when the base is mounted on the support, said graduated scale being visible through said transparent window.

2. The equipment according to claim 1, wherein the lower end of the elastically deformable stem is anchored to the base by means of a first and a second magnetic element adapted to attract each other; the first magnetic element being integrally carried by the lower end of the elastically deformable stem and being arranged resting on an upper face of the base.

3. The equipment according to claim 2, further comprising a plurality of second magnetic elements carried integrally by the base each in correspondence with one of said second predetermined positions, the second magnetic element being embedded or molded in the thickness of the base.

4. The equipment according to claim 3, wherein said first and second magnetic elements are formed by a first and a second magnet permanently arranged with opposite poles facing the base.

5. The equipment according to claim 2, wherein the second magnetic element is resting on a lower face of the base, in a position corresponding to that occupied by the first magnetic element on the upper face of the base, so that the base remains clamped between the first and the second magnetic elements with predetermined force.

6. The equipment according to claim 5 wherein the upper and lower faces of the base are smooth and flat so that the player can make manually slide the first and second magnetic element on them while maintaining the first and second magnetic elements magnetically coupled to each other and mechanically coupled to each other and with the base, by way of a magnetic force.

7. The equipment according to claim 2, wherein said obstacles can be stably coupled to the base so as to define between each other, selectively, a plurality of gates having a width, measured transversely to a direction along which the player hits the ball, progressively increasing or decreasing.

8. The equipment according to claim 1, wherein the base comprises indication elements to perform predetermined orientation of the base towards a target consisting of at least one first linear marking provided starting from said receiving element for receiving the ball on the base and directed towards said obstacles; the base also being provided with second markings to mark on the base said plurality of second predetermined positions; said first and second markings being carried by one of the opposite upper and lower faces of the base so as to result visible from the upper face ; said base being formed by a rigid or flexible, flat sheet, of a polymeric material, made of transparent material, selected from the group consisting of acetalic resins or silicone resins, on one face of which sheet said markings are obtained or made.

9. The equipment according to claim 1, wherein said receiving element for receiving in use a ball on the base comprises a concave seat obtained on the base and adapted to mark a first predetermined position wherein to put, in use, the ball and adapted to stably receive, in use, the ball until the latter, in use, is hit by the player.

10. The equipment according to claim 9, wherein the base is provided, near said receiving element for receiving the ball on the base, with a line or a projection arranged transversely to a predetermined direction along which the player hits the ball, in use; the line or projection being adapted to serve the player as a reference to correctly orient a club to hit the ball with respect to the ball itself.

11. The equipment according to claim 1, wherein said elastically deformable stems are formed by helicoidal springs with a low rigidity; and wherein said plates are made of a plastic material and so as to have a mass equal to about one fortieth of that of a golf ball.

* * * * *